United States Patent [19]

Hledin

[11] Patent Number: 4,635,591

[45] Date of Patent: Jan. 13, 1987

[54] INTERNAL-COMBUSTION ENGINES

[76] Inventor: Alexander S. Hledin, 102 Elm Street, Hudson, Quebec, Canada, H0P 1H0

[21] Appl. No.: 721,891

[22] Filed: Apr. 11, 1985

Related U.S. Application Data

[63] Continuation-in-part of Ser. No. 659,908, Oct. 11, 1984, abandoned.

[51] Int. Cl.[4] ..... F02B 75/00

[52] U.S. Cl. ..... 123/37; 123/41.32; 123/41.82 R; 123/310; 123/193 H

[58] Field of Search ..... 123/37, 65 R, 309, 310, 123/638, 193 H, 193 CH, 41.01, 41.31, 41.32, 41.72, 41.82 R, 41.85

[56] References Cited

U.S. PATENT DOCUMENTS

| | | | |
|---|---|---|---|
| 894,568 | 9/1907 | Avery | 123/41.31 |
| 2,030,894 | 2/1936 | Pennebaker | 123/41.32 |
| 2,968,292 | 1/1961 | Kelly | 123/41.82 |
| 2,986,130 | 5/1961 | McMillan | 123/41.82 |
| 4,258,670 | 3/1981 | Thery | 123/73 B |
| 4,484,550 | 11/1984 | Gadefelt et al. | 123/193 H |
| 4,538,568 | 9/1985 | Fujikawa et al. | 123/638 |

FOREIGN PATENT DOCUMENTS

| | | | |
|---|---|---|---|
| 879926 | 3/1943 | France | 123/310 |
| 1217420 | 5/1960 | France | 123/638 |
| 503775 | 12/1954 | Italy | 123/638 |
| 0066664 | 5/1980 | Japan | 123/638 |
| 527903 | 10/1940 | United Kingdom | 123/310 |

*Primary Examiner*—Charles J. Myhre
*Assistant Examiner*—David A. Okonsky
*Attorney, Agent, or Firm*—Samuel Meerkreebs

[57] ABSTRACT

In a cylinder head for internal combustion engines, the engine having a longitudinal axis and intake and exhaust ports, the head including at least one concave portion defining a curved wall of a combustion chamber, the combustion chamber being provided with at least two spark plugs, the improvement comprising, providing in the cylinder head, a fluid channel means which extends into a cone-like projection for cooling the central part of the combustion chamber. The cone-like projection is located between the spark plugs and extends into the combustion chamber.

9 Claims, 11 Drawing Figures

INTERNAL-COMBUSTION ENGINES

This application is a continuation-in-part of application Ser. No. 659,908, filed Oct. 11, 1984 and now abandoned.

BACKGROUND OF INVENTION (a) Field of the Invention

The present invention relates to improvements in internal combustion engines and more particularly to improvements in cylinder heads therefor.

(b) Description of the Prior Art

A number of prior art internal combustion engines perform better than others as a result of a number of improvements made in their design, however, these improved engines still do not perform in a truly efficient manner. Applicant, through an extensive program of testing, has identified two major areas which contribute to this, namely inadequate cooling in certain parts of the engine and particularly in the case of two stroke engines, incomplete and thus inefficient combustion of the fuel, i.e., fuel-air mixture.

Regarding a more specific area, research has shown limited development has taken place over the years in the field of two stroke marine type engines, i.e., with a view to improving their operating efficiency, notwithstanding their common use in competitive sporting activities. The present invention specifically addresses this area.

Turning first to the question of inadequate engine cooling. Tests have revealed one of the hottest parts of an internal combustion engine during operation thereof, is the area of the mounting of the sparkplug, i.e., the threaded mounting portion, normally residing in the head of the engine. Although various designs of cylinder head have been produced, having for example, fluid cooling channels therein, none have been designed to efficiently cool this hottest part of the head. Reference is made for example, to McDonald's U.S. Pat. No. 1,378,254, dated May 17, 1921, showing coolant channels in the head in the vicinity of the sparkplug. In such instance, the threaded mounting of the sparkplug is located remote from the coolant channels. A further example of prior art engine having coolant channels in the head, located remote from the sparkplug threaded mounting portion, is Chard's U.S. Pat. No. 3,003,485, dated Oct. 10, 1961. A more recent example of the prior art head design having coolant channels therein, is that disclosed in Kueny's U.S. Pat. No. 3,667,431, dated June 6, 1972. Although the fluid channels are located adjacent the deemed hottest portion of the sparkplug, they do not permit fluid flow completely around the same. Furthermore, in this design, coolant flow is restricted by requiring it to move in a first direction and then in a reverse second direction, thus to enter and exit at one side or one end of the head. the evident drawback with this design is that the coolant removes heat from the first sparkplug and has it reapplied together with heat from the second sparkplug, upon exiting from the head. The situation is compounded when more than two cylinders and accompanying sparkplugs are present.

Turning now to the question of incomplete combustion of fuel in the combustion chamber of two stroke engines. Tests have revealed, the incomplete burning of the fuel occurs as a result of a number of things, including inadequate igniting means for the fuel, inadequate directing of the fuel within the combustion chamber for its ignition and incorrect positioning of the igniting means within the combustion chamber, also incorrect positioning of the igniting means relative to the fuel entry position into the chamber. Furthermore, lack of means to ensure proper movement of the fuel to obtain combustion.

Although various designs of engines and various designs of cylinder heads have been produced, having substantial fuel igniting means comprising two or more sparkplugs per cylinder, for example, such have not provided, in the case of two stroke engines, efficient combustion of the fuel in the combustion chamber. Although four cycle engine combustion chamber designs exist which include a contour feature similar to that of the present design discussed hereinafter, such is for an entirely different purpose, i.e., to enhance four cycle operation.

As mentioned above, the use of two sparkplugs in the combustion chamber of an internal combustion engine is well known, as exemplified by Utz's U.S. Pat. No. 1,015,101, dated Jan. 16, 1912. This reference, however, discloses the use of two sparkplugs per cylinder in a four cycle engine, i.e., one employing inlet and outlet valves, providing combustion of the fuel in a manner contrary to that of the present invention, as discussed hereinafter. Multi sparkplugs per cylinder is also disclosed in Woolson's U.S. Pat. No. 1,532,292, dated Apr. 7, 1925. The use of two sparkplugs per cylinder in aircraft engines is also known. In such instances, the second plug is supplied as a safety measure, namely to provide improved reliability, thus as a backup should the one sparkplug fail. Harper's U.S. Pat. No. 2,025,202 dated Dec. 24, 1935, discloses a two-cycle engine having two sparkplugs in its cylinder, however, the sparkplugs are not of similar type and are not arranged whereby both extend into the combustion chamber via the wall thereof, to afford efficient and desirable combustion effect.

SUMMARY OF THE INVENTION

The aforementioned problem regarding inadequate cooling is overcome by the present invention by providing a fluid flow which passes once through the cylinder head i.e., entering adjacent one end and exiting adjacent the opposite end thereof, and furthermore, affording complete encirclement of the threaded mounting of the sparkplug(s). In one preferred embodiment, according to the invention, the fluid flow is diverted by strategically placed finning in the flow channel.

The aforementioned problem regarding inefficient combustion of fuel, is overcome by the present invention, by providing at least two sparkplugs per cylinder, which are of common type and which both fully extend into the combustion chamber and are particularly arranged one to another, also in relation to the fuel inlet supply, to provide cooperative action one to another, the details of which are discussed hereinafter.

In one aspect of the present invention, there is provided in a cylinder head for a two cycle internal combustion engine, the engine having a longitudinal axis and intake and exhaust ports, the head including a least one concave portion defining a curved wall of a combustion chamber, the improvement comprising providing in the curved wall at least a pair of spaced apart apertures, the apertures each comprising a threaded bore adapted to receive therein the threaded mounting portion of a sparkplug comprising an electrode, the threaded bores being so arranged one to another, the respective longitudinal axes thereof extend angularly one to another whereby the threaded bores extend completely through the wall to at least partially face one another, the bores further being positioned in the head whereby when the head is assembled to the engine, the relationship of the bores to the inlet port or ports affords combustion of fuel entering via the port or ports to occur simultaneously about the electrodes of the sparkplugs assembled in the bores, thereby ensuring highly efficient burning of the fuel.

In a further aspect of the present invention there is provided in a cylinder head for an internal combustion engine, the head including at least one portion defining a wall of a combustion chamber, the wall including at least one aperture therein defining a threaded bore for the reception of the threaded portion of a sparkplug, the improvement comprising providing the cylinder head, a fluid channel means which extends in spaced adjacent relation to the threaded bore, for use in removing heat therefrom during operation of said engine, the fluid channel means including a fluid inlet adjacent one end of the head and a fluid outlet adjacent the other opposite end of the head.

BRIEF DESCRIPTION OF THE DRAWINGS

The invention is illustrated by way of example in the accompanying drawings wherein.

DESCRIPTION OF PREFERRED EMBODIMENTS

Figure 1:
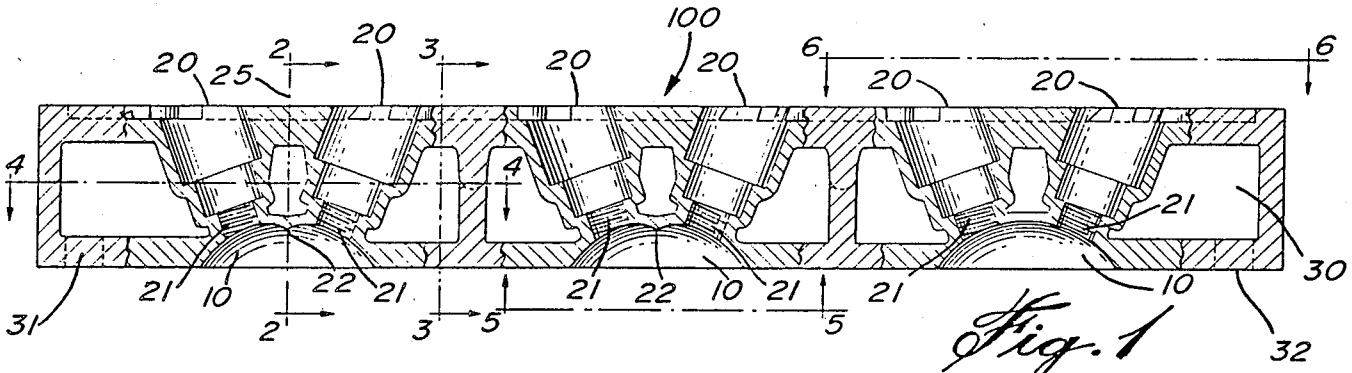
FIG. 1 is a sectioned side view taken through a cylinder head in accordance with the present invention.

Referring to FIG. 1, there is seen a cylinder head 100 for fitting to the cylinder block of a two cycle three cylinder internal combustion engine (not shown).

Cylinder head 100 is oriented when assembled to the cylinder block such that side A is located on the exhaust side of the block and side B is located on the fuel/air intake side of the block. Cylinder head 100 further includes three concave portions 10, clearly seen in FIG. 1 and each defining a curved top wall of a respective combustion chamber of the engine.

Figure 7:
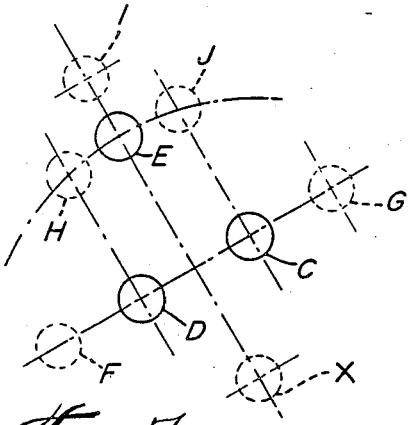
FIG. 7 is a diagrammatic view showing the relationship of the sparkplug mounting bores in the cylinder head shown in FIG. 1, with reference to one cylinder, and accordingly the relationship of the sparkplug electrodes to the fuel inlet port of one particular model of two cycle engine, when the head is fitted thereto.
Figure 5:
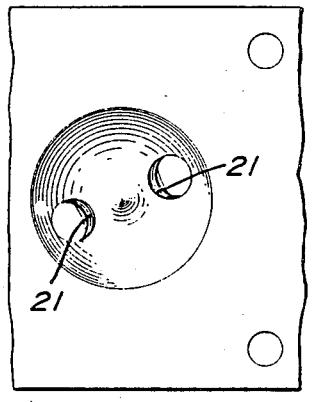
FIG. 5 is a part bottom view of the cylinder head taken along line 5—5 in FIG. 1.

In the one example of preferred embodiment disclosed, although not evident from FIG. 1 since the cylinder block is not shown, the sparkplug electrodes are positioned, in the case of each cylinder, relative to the fuel inlet port in the cylinder block, according to that shown diagrammatically in FIG. 7.

Referring to FIG. 7, C and D denote the electrodes and E, the fuel inlet port. As seen in the one embodiment shown, the electrodes C and D are symmetrically arranged relative inlet port E, ensuring the fuel reaches each electrode simultaneously for simultaneous combustion. F and G denote additional electrodes of additional sparkplugs of a further embodiment and H, I and J, denote additional ports or alternative positions of the inlet port, still arranged symmetrically of the electrodes C and D. In the case of the embodiment disclosed, the exhaust port is also located symmetrically of the electrodes C and D, such being denoted by X in FIG. 7.

As will be understood, various cylinder heads may be produced in accordance with the present invention for fitting to various cylinder blocks, the latter having any practical number of cylinders.

It is visualized, embodiments in accordance with the present invention may not have the threaded bores for the sparkplugs arranged exactly symmetrically with the inlet port or ports. In such instances, the design would be adjusted to compensate for this to ensure simultaneous combustion by the electrodes occurs, as when the electrodes are symmetrically located with respect of the fuel inlet. Such conceivably may comprise a particular shaping of the cylinder or piston or both. On the other hand, an engine for which the cylinder head is to be fitted, may dictate a non-symmetrical positioning of the electrodes relative the inlet port in order to achieve simultaneous combustion as discussed.

Cylinder head 100 is further seen to include a pair of spaced apart apertures 20, each comprising a threaded bore 21 adapted to receive therein the threaded mounting portion of a sparkplug. As best seen in FIG. 1, the longitudinal axis of bores 21 are angularly inclined one to another whereby they extend completely through the wall and thus the concave portion 10, to at least partially face one another.

Figure 4:
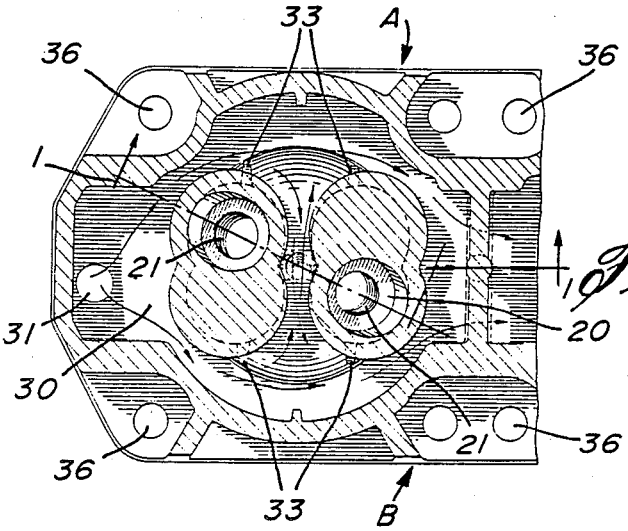
FIG. 4 is a sectional view illustrating the present invention.

In the case of the one preferred embodiment shown, a conical-like protrusion 22 is provided on the surface of wall 10, such being located symmetrically of the point coincident with the respective cylinder axis and centrally intermediate apertures 20. Protrusions 22 discussed hereinafter, are provided for use in creating a swirling mixing action of the fuel/air mixture to aid efficient burning thereof and are provided with a cooling channel therein, as best seen in FIG. 4. The surface contour of protrusion 22 may comprise a number of configurations including the one shown and which cooperates with the selected position of the sparkplugs (not shown), determined by apertures 20 positioned relative one another and the central axis of portion 10, in the case of the preferred embodiment. The dotted line in FIG. 2 indicates the chamber contour without protrusion 22. As seen in FIG. 1, protrusion 22 affords coolant channel 30, discussed hereinafter, to extend more closely to threaded bores 21. As further seen, apertures 20 are located on an axis 23 which is angularly disposed respective the longitudinal axis 24 of head 100 and accordingly the engine. In the case of the one preferred embodiment shown, axis 23 is disposed at an angle of 25° to longitudinal axis 24 and passes centrally of concave portion 10. As may be realized, this angular disposition is determined by the intake and exhaust positions relative the sparkplug and thus may vary from engine to engine.

A particularly important aspect to note regarding the preferred embodiment shown is that apertures or bores 21 are threaded completely through the wall surface 11 to ensure the sparkplugs fully extend whereby to fully cooperate with protrusion 22 to cause efficient combustion of the fuel/air mixture supplied by the engine carburator (not shown).

As seen in FIG. 1, bores 21 are also inclined one to another symmetrically of the cylinder axis 25 and again in the case of the one preferred embodiment shown, are arranged to provide an inclusive angle of 40°. As will be further understood, the said inclusive angle may vary from engine to engine, also possibly being affected by the shape of the protrusion 22, if present.

As best seen from FIGS. 1 and 4, cylinder head 100 includes a fluid coolant channel 30 extending completely throughout the length of the head and which comprises coolant inlet 31 and a coolant outlet 32, disposed at opposite ends thereof. As will be appreciated, inlet 31 and outlet 32 may become reversed and is dependent upon to which end of the head the coolant is supplied. Coolant channel 31 thus passes over the domed and concave portions 10 to provide cooling therefor and moreparticularly apertures 20, bores 21, to provide cooling for the threaded portions of the spark plugs. To further facilitate the cooling thereof, the present embodiment provides for coolant channel 30 to pass between apertures 20, thus to provide complete encirclement thereof for maximum cooling effect, see FIG. 4. If desired, finning may be strategically located within fluid channel 30 to enhance circulation of the coolant over the various surfaces of the head. Such is shown in the one preferred embodiment disclosed.

Figure 2:
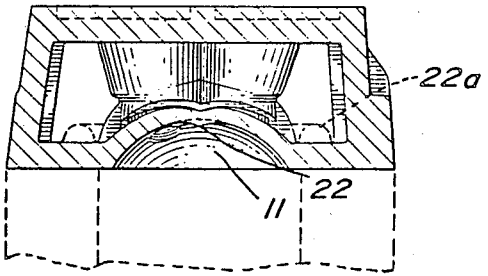
FIG. 2 is a cross-sectional view taken along line 2—2 in FIG. 1 but showing the cylinder head full width.

Preferably, to increase cooling efficiency and which also facilitates design, the coolant channel 30 extends in dimple fashion, seen in FIG. 2, to provide the protrusion 22 and bring the coolant into even closer vicinity of the threaded bores 21.

Figure 3:
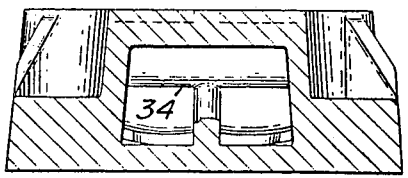
FIG. 3 is a cross-sectional view taken along line 3—3 in FIG. 1 but showing the cylinder head full width.

As seen in FIG. 4, a plurality of fins 33 are shown, such extending adjacent the lower outer surface of each concave portion 10. Also shown is a central protrusion, as viewed from above a cross-section of the cylinder head, wherein the coolant flow channel is defined in the central cone-like projection for cooling the central part of the combustion chamber. Additional ribs 34, seen in FIG. 3, may also be provided if desired, serving as additional reinforcing and diversion means for the coolant flow circulating through channel 30 of the head 100 during operation of the engine. In the case of the preferred embodiment disclosed, such is a cylinder head for a two stroke marine engine where the coolant is not supplied from a closed recirculating system, though of course, such may be an optional consideration.

Figure 6:
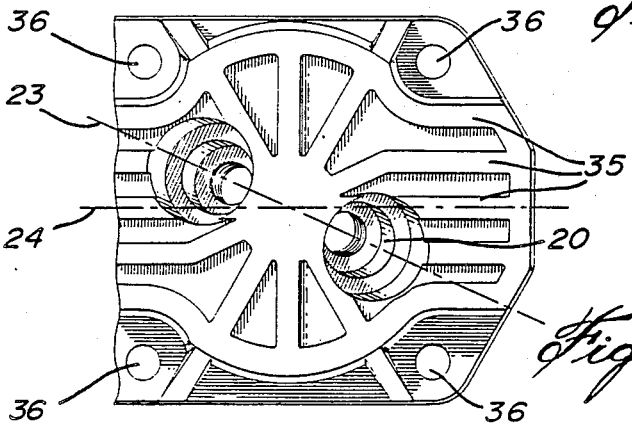
FIG. 6 is a part top view of the cylinder head taken along line 6—6 in FIG. 1.

Attention is directed to FIG. 6 disclosing a plurality of shallow ribs 35 extending over the outer surface of head 100. Ribs 35 are strategically placed to provide structural reinforcing for the head and also to enhance cooling thereof. Head 100 may comprise any suitable material including lightweight materials such as aluminum. A plurality of apertures 36 are provided in a manner known per se in head 100 for use in securing the same to the engine block in conventional manner.

A further optional feature is seen in FIG. 2, namely a circular rib **22*a*. The latter serves to increase the thickness of material comprising the lower wall of the fluid coolant channel 30 where it comes into contact with the cylinder block, also denoted by dotted line in FIG. 2. The purpose of circular rib 22*a*, which if utilized would respectively encircle each of the domes comprising the outer walls of concave portion 10, is to counter any tendency to warping of the lower wall of the fluid coolant channel 30**, caused by generated engine heat.

Figure 8:
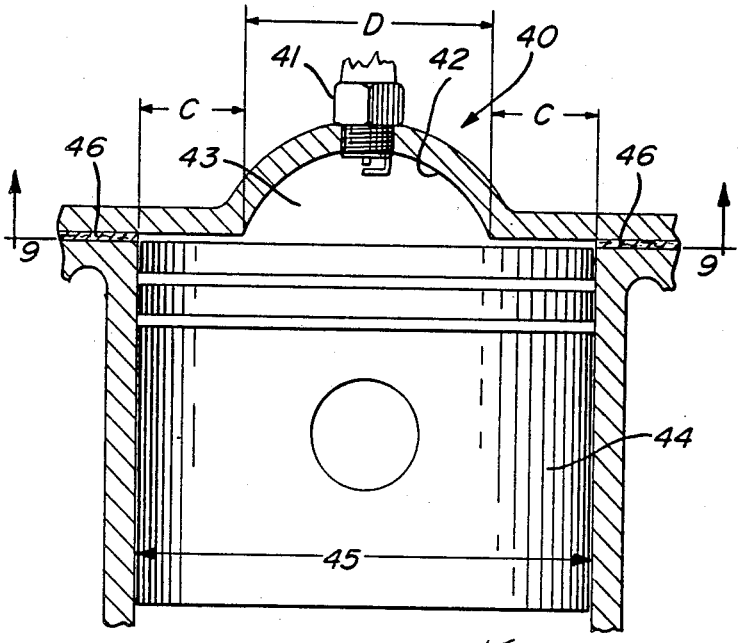
Fig. 8 (PRIOR ART)
FIG. 8 is sectioned side view taken through a cylinder head of the prior art including a piston.
Figure 9:
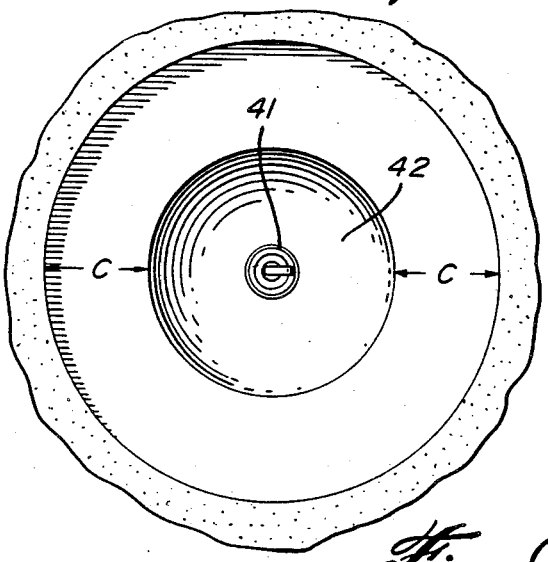
Fig. 9 (PRIOR ART)
FIG. 9 is a view taken along line 9—9 in FIG. 8.

Attention is directed to FIG. 8 showing a typical prior art two cycle engine 40 having a single centrally located sparkplug 41 in the curved top wall 42 of its combustion chamber 43 comprising the cylinder head. In this knonn design, a relatively wide squish band area C is provided and purposely so, i.e. in order to promote high turbulence of the fuel mixture just prior to combustion by sparkplug 41.

In operation, as piston 44 approaches the top of bore 45, it violently "squeezes" out the mixture in the squish area C, the top of piston 44 being separated from head 42 at the top of its stroke by only the thickness of head gasket 46, usually in the neighbourhood of 0.040 inches. This induces violent turbulence of the fuel mixture to force it all into chamber 43 where it is subsequently ignited by sparkplug 41. Resulting pressure in produced in chamber 43 which acts upon a portion, namely the crown of, piston 44 to create a downward force, which is directly proportional to the pressure in chamber 43 and the area of the piston which is exposed to the chamber 43.

It is evident that if the chamber area is widened at its base adjacent the top of piston 44, the more piston area becomes available and therefore greater downward force is produced upon piston 44.

However, experiments have revealed that the optimum balance respective the prior art chambers between the area under chamber 43 indicated D in FIG. 8, and the squish band C, is represented by a ratio of 60:40 or expressed another way, 40% of the total area of the piston top surface is covered by the squish band area and 60% by the chamber 43 area.

It has also been found that if this ratio is altered, then harmful detonation results with loss of power. On the other hand, if chamber 43 area is enlarged then detonation results because the fuel mixture at the outer rim area of the chamber, self-ignites due to pressure increase rather than by spark induced combustion. Thus a limit exists as to the distance the chamber periphery can be to the sparkplug electrode.

Figure 10:
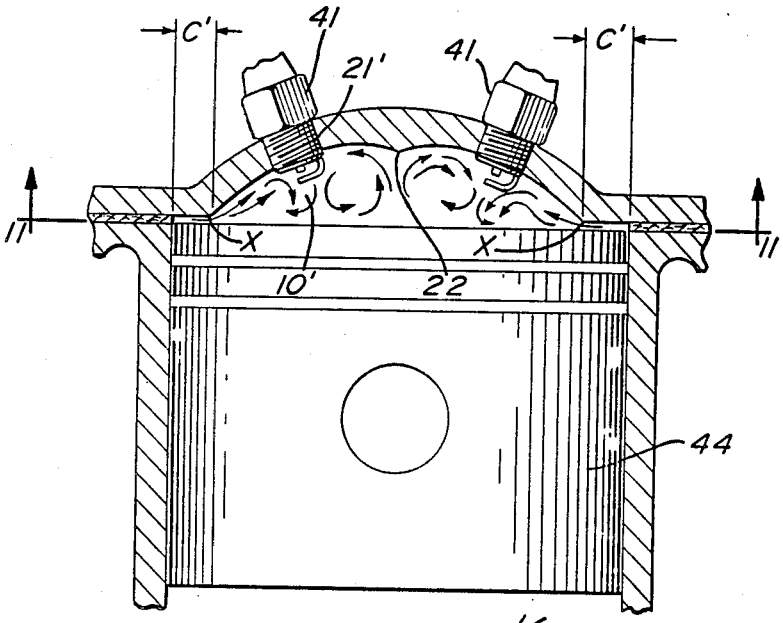
FIG. 10 is a sectioned side view taken through a cylinder head in accordance with the present invention.

The above noted problems are overcome enabling an increased combustion area over the piston by the arrangement shown in FIG. 10. Referring to FIG. 10, it is seen there is provided a cylinder head similar to that shown in the central portion of FIG. 1, but having a reduced, in comparison to the prior art, circumferentially extending squish area C'. In FIG. 10, the head includes a concave portion 10' having a protrusion 22 intermediate a pair of sparkplugs 41, threaded into respective bores 21'.

Figure 11:
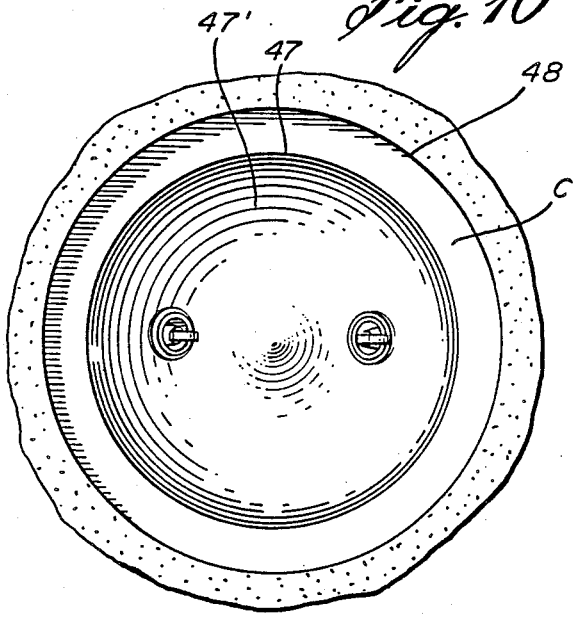
FIG. 11 is a view taken along line 11—11 in FIG. 10.

FIG. 10 thus shows the curved top wall of the combustion chamber of an engine, the curved top wall terminating at X to define a circumferentially extending edge 47, as seen in FIG. 11. Edge 47 extends to define an area 47' within the cross-sectional area of the combustion chamber the periphery of which is denoted 48 in FIG. 11, and provides circumferentially extending squish area C.

In the case of the one preferred embodiment disclosed, i.e. FIG. 10, squish area C represents approximately 20% of the cross-sectional area of the combustion chamber, the periphery of which as indicated above is denoted 48. In FIG. 10, the arrows shown represent the mixing of the fuel mixture about the sparkplug electrodes, directed by protrusion 22 and that being squeezed from the squish area C.

It is to be understood, respective various embodiments of the present invention, that the size of protrusion 22 may be varied as also may be the magnitude of the squish area, and that there is a relationship between protrusion or protruberance 22 and the squish area C. Further, that it is the presence of protrusion 22 which permits the squish area to be reduced from the conventional prior art size aforediscussed.

From the foregoing and with reference to the one preferred embodiment shown in FIG. 10, it will be seen, the squish area is reduced by 50% from the conventional area aforediscussed, that such results in significantly less turbulence of the fuel mixture. That protrusion 22 enhances the mixing thus to augment to reduce the undesirable turbulence, i.e., to permit the flow of mixture to be directed around the sparkplug electrodes for substantially simultaneous combustion thereby. Further, that the two sparkplugs are located and oriented in a manner, no portion of the combustion chamber is too far from a point of ignition, thus again allowing for a wider than conventional combustion chamber to be provided.

Referring briefly to the operation of an engine fitted with a cylinder head in accordance with the present invention. Fuel, i.e., fuel/air mixture enters the combustion chamber via the inlet port, for example, port E seen in FIG. 7, in manner known per se. Due to the strategic location of the sparkplug electrodes C and D depending of bores 21, the fuel reaches both electrodes simultaneously and is accordingly ignited simultaneously. This insures virtually instant combustion of all the fuel. The said strategic location in fact ensures the quantity of fuel entering the combustion chamber is divided equally about the vicinity of the two electrodes, unlike in the case of the prior art engines having two sparkplugs, where the fuel reaches the electrodes successively and results in non-total ignition of the fuel. Unlike the prior art designs, two sparkplug electrodes according to the present invention, being of similar type, are cooperatively arranged to at least partially face one another whereby they are directed toward the center of the fuel movement path. Furthermore, the protrusion 22 guides the fuel to "center" it about the respective electrodes ensuring even more efficient burning of the already guided fuel. It will be understood that by the word "guided" is means strategically locating the two or more sparkplug electrodes directly in the path of the incoming fuel or vice versa, in the case of new engine designs.

It will be evident from the foregoing, a highly improved igniting means for the fuel is provided compared to that of the prior art designs, such offering a substantial increase in igniting power, and arranged to execute more efficient fuel combustion. Also, that a much improved directing of the fuel is provided. These features, together with the others mentioned, including improved cooling afforded by the present invention, results in a much improved internal combustion engine compared to those of the prior art.

Test results obtained confirm engines fitted with cylinder heads in accordance with the present invention have substantial increased power output compared to when fitted with conventional prior art cylinder heads. Test results obtained also indicate the ability to utilize substantially lower octane fuel, as well as being able to tolerate a leaner fuel mixture, for a given power requirement.

Accordingly, the present invention is deemed to represent a major advance in the design of two-cycle internal combustion engines in particular and the cooling of internal combustion engines in general.

We claim:

1. A cylinder head for a two and four cycle internal combustion engine, the cylinder head having at least one combustion chamber, each combustion chamber provided with at least a pair of spaced apart spark plugs, which ignite during each power stroke, provided in the cylinder head and protruding within the combustion chamber, the cylinder block defining a concavely curved roof for the combustion chamber with a central cone like projection extending downwardly into said combustion chamber, between the spark plugs, adapted to provide directed circulation of gases within the combustion chamber towards the respective spark plugs, and coolant flow channels provided in the cylinder head with a coolant flow channel defined in the central cone-like projection for cooling the central part of the combustion chamber.

2. A cylinder head as defined in claim 1, wherein the coolant flow channels communicate throughout the cylinder head with an inlet port at one end of the cylinder head and an outlet port at the other end of the cylinder head and surround the spark plugs and in particular, communicate with the channel defined in the central cone-like projection so as to withdraw heat from the cylinder head uniformly about the combustion chamber.

3. The improvement as defined in claim 1, wherein said curved top wall terminates to define a circumferentially extending edge, said circumferentially extending edge defining a first area extending within the cross-sectional area of said combustion chamber and providing a second squish area, said squish area extending about said first area and sized such that it represents less than 40% of said cross-sectional area of said combustion chamber.

4. The improvement as defined in claim 3, wherein said squish area is sized such that it represents approximately 20% of said cross-sectional area of said combustion chamber.

5. A cylinder head as defined in claim 1, wherein the spark plugs are provided in spaced apart apertures, with the apertures each comprising a threaded bore, the respective longitudinal axes of the bores extending at an angle to each other.

6. A cylinder head as defined in claim 5, wherein the respective longitudinal axis of the threaded bores extend angularly one to another and the longitudinal axes of the bore at a given combustion chamber are in a plane at an angle to the longitudinal axis of the cylinder head.

7. A cylinder head as defined in claim 6, wherein the angle between the plane including the axes of the threaded bores and the longitudinal axis of the cylinder head is 25°.

8. A cylinder head as defined in claim 5, wherein the longitudinal axes of the bores intersect each other at an angle of 40°.

9. A cylinder head as defined in claim 8, wherein the longitudinal axes of the bores intersect at the intersection with the vertical axis of the combustion chamber.

* * * * *